US010692416B2

(12) United States Patent
Jang et al.

(10) Patent No.: US 10,692,416 B2
(45) Date of Patent: Jun. 23, 2020

(54) DISPLAY APPARATUS HAVING DATA DRIVING PART TO SELECTIVELY STORE AND OUTPUT COLOR GAMMA DATA AND METHOD OF DRIVING THE SAME

(71) Applicant: Samsung Display Co., Ltd., Yongin-Si, Gyeonggi-Do (KR)

(72) Inventors: Yongjun Jang, Yongin-si (KR); Cheolwoo Park, Suwon-si (KR); Young-Soo Hwang, Suwon-si (KR); Jaewoong Kang, Jeonju-si (KR); Seunghwan Park, Anyang-si (KR); Donggyu Lee, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 17 days.

(21) Appl. No.: 15/689,400

(22) Filed: Aug. 29, 2017

(65) Prior Publication Data

US 2018/0068607 A1 Mar. 8, 2018

(30) Foreign Application Priority Data

Sep. 6, 2016 (KR) ..... 10-2016-0114386

(51) Int. Cl.
*G09G 5/10* (2006.01)
*G09G 3/20* (2006.01)

(52) U.S. Cl.
CPC ..... *G09G 3/2003* (2013.01); *G09G 3/2092* (2013.01); *G09G 2310/027* (2013.01); *G09G 2320/0673* (2013.01)

(58) Field of Classification Search
CPC ... G09G 3/3685; G09G 3/2003; G09G 3/2092
USPC ..... 345/95
See application file for complete search history.

(56) References Cited

U.S. PATENT DOCUMENTS

| | | | | |
|---|---|---|---|---|
| 8,493,303 | B2 | 7/2013 | Furihata et al. | |
| 2006/0256065 | A1* | 11/2006 | Jung | G09G 3/3685 345/100 |
| 2009/0040167 | A1* | 2/2009 | Sun | G09G 3/3696 345/99 |
| 2010/0007680 | A1* | 1/2010 | Yu | G09G 3/2003 345/690 |
| 2012/0320297 | A1* | 12/2012 | Itsumi | G09G 3/3648 349/43 |
| 2013/0135186 | A1* | 5/2013 | Zhang | G09G 3/3696 345/88 |
| 2015/0228232 | A1* | 8/2015 | Lee | G09G 3/3607 345/88 |

FOREIGN PATENT DOCUMENTS

KR 101117981 B1 11/2006

* cited by examiner

*Primary Examiner* — Adam J Snyder
(74) *Attorney, Agent, or Firm* — Cantor Colburn LLP

(57) ABSTRACT

A display apparatus includes a display panel which displays an image, and includes a gate line and a data line, a gate driving part which outputs a gate signal to the gate line and a data driving part which outputs a data signal to the data line, and selectively outputs first color gamma data, second color gamma data and third color gamma data in response to a selection signal, and generates the data signal using the first color gamma data, the second color gamma data and the third color gamma data.

21 Claims, 5 Drawing Sheets

DISPLAY APPARATUS HAVING DATA DRIVING PART TO SELECTIVELY STORE AND OUTPUT COLOR GAMMA DATA AND METHOD OF DRIVING THE SAME

This application claims priority to Korean Patent Application No. 10-2016-0114386, filed on Sep. 6, 2016, and all the benefits accruing therefrom under 35 U.S.C. § 119, the content of which in its entirety is herein incorporated by reference.

BACKGROUND

1. Field

Exemplary embodiments of the invention relate to an image display, and more particularly to a display apparatus and a method of driving the display apparatus.

2. Description of the Related Art

A display apparatus generally includes a display panel and a display panel driving apparatus.

The display panel generally includes a gate line, a data line, and a pixel defined by the gate line and the data line.

The display panel driving apparatus generally includes a gate driving part, a data driving part and a timing controlling part. The gate driving part outputs a gate signal to the gate line, the data driving part outputs a data signal to the data line, and the timing controlling part controls a timing of the gate driving part and a timing of the data driving part.

The data driving part generates the data signal using gamma data indicating a luminance according to a grayscale.

When the display panel is a liquid crystal display panel including a liquid crystal, a gamma characteristic of a red color, a gamma characteristic of a green color and a gamma characteristic of a blue color are similar to or substantially the same with one another. Alternatively, when the display panel is an organic light emitting diode ("OLED") display panel including an OLED, the gamma characteristic of the red color, the gamma characteristic of the green color and the gamma characteristic of the blue color are different from one another. In addition, when the display panel is a quantum dot display panel including a quantum dot, the gamma characteristic of the red color, the gamma characteristic of the green color and the gamma characteristic of the blue color are different from one another.

SUMMARY

Exemplary embodiments of the invention provide a display apparatus which decreases a size and a manufacturing cost of the display apparatus.

Exemplary embodiments of the invention also provide a method of driving the above-mentioned display apparatus.

According to an exemplary embodiment of the invention, a display apparatus includes a display panel, a gate driving part and a data driving part. The display panel displays an image, and includes a gate line and a data line. The gate driving part outputs a gate signal to the gate line. The data driving part outputs a data signal to the data line, to selectively output first color gamma data, second color gamma data and third color gamma data in response to a selection signal, and generates the data signal using the first color gamma data, the second color gamma data and the third color gamma data.

In an exemplary embodiment, the data driving part may include a look-up table ("LUT") part which stores the first color gamma data, the second color gamma data and the third color gamma data.

In an exemplary embodiment, the LUT part may include a first LUT which stores the first color gamma data, a second LUT which stores the second color gamma data, and a third LUT which stores the third color gamma data.

In an exemplary embodiment, the data driving part may further include a selecting part which selects one of the first LUT, the second LUT and the third LUT in response to the selection signal, in order to selectively output the first color gamma data, the second color gamma data and the third color gamma data.

In an exemplary embodiment, the selecting part may selectively output the first color gamma data, the second color gamma data and the third color gamma data by selecting the first LUT, the second LUT and the third LUT one by one.

In an exemplary embodiment, the selecting part may receive gamma data including the first color gamma data, the second color gamma data and the third color gamma data.

In an exemplary embodiment, the selecting part may selectively store the first color gamma data, the second color gamma data and the third color gamma data by selecting the first LUT, the second LUT and the third LUT one by one.

In an exemplary embodiment, the data driving part may receive the gamma data through an inter-integrated circuit ("I2C") communication using a serial data line and a serial clock line.

In an exemplary embodiment, the data driving part may include a digital gamma part which receives first gamma point data designating N (N is a natural number) gamma point, and to output second gamma point data designating 2N gamma points.

In an exemplary embodiment, the digital gamma part may receive a polarity control signal controlling a positive polarity and a negative polarity of the data signal.

In an exemplary embodiment, the digital gamma part may include a first decoder which outputs gamma point data of the positive polarity, and a second decoder which outputs gamma point data of the negative polarity.

In an exemplary embodiment, the first color gamma data may include 2N gamma voltages.

In an exemplary embodiment, the second color gamma data may include 2N gamma voltages.

In an exemplary embodiment, the third color gamma data may include 2N gamma voltages.

In an exemplary embodiment, the data driving part may include a serial parallel converting part which receives image data for displaying the image and output parallel data of P bit, where P is a natural number, and an interpolating part which receives the parallel data and to output data of (P+Q) bit, where Q is a natural number.

In an exemplary embodiment, the display panel may include a first color pixel, a second color pixel and a third color pixel, and a size of the first color pixel, a size of the second color pixel and a size of the third color pixel are different from one another.

In an exemplary embodiment, the first color pixel may have a first length, the second color pixel may have a second length longer than the first length, and the third color pixel may have a third length longer than the second length, in a direction in which the gate line extends.

In an exemplary embodiment, the first color gamma data may be red gamma data, the second color gamma data may be green gamma data, and the third color gamma data may be blue gamma data.

In an exemplary embodiment, the display panel may be a quantum dot display panel including a quantum dot.

According to an exemplary embodiment of the invention, a method of driving a display apparatus includes selectively storing first color gamma data, second color gamma data and third color gamma data one by one in response to a selection signal, selectively outputting the first color gamma data, the second color gamma data and the third color gamma data one by one in response to the selection signal, generating a data signal using the first color gamma data, the second color gamma data and the third color gamma data, and outputting the data signal to a data line of a display panel, and outputting a gate signal to a gate line of the display panel.

According to the invention, a data driving part stores and outputs first color gamma data, second color gamma data and third color gamma data. Therefore, although a display panel includes a first color pixel, a second color pixel and a third color pixel having different sizes from one another, and thus a gamma characteristic of a first color, a gamma characteristic of a second color and a gamma characteristic of a third color are different from one another, an image of improved display quality may be displayed adaptively to the first color, the second color and the third color.

In addition, a decoder according to the first color, the second color and the third color is not desired to the data driving part, and thus a size and a manufacturing cost of a display apparatus may be decreased.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
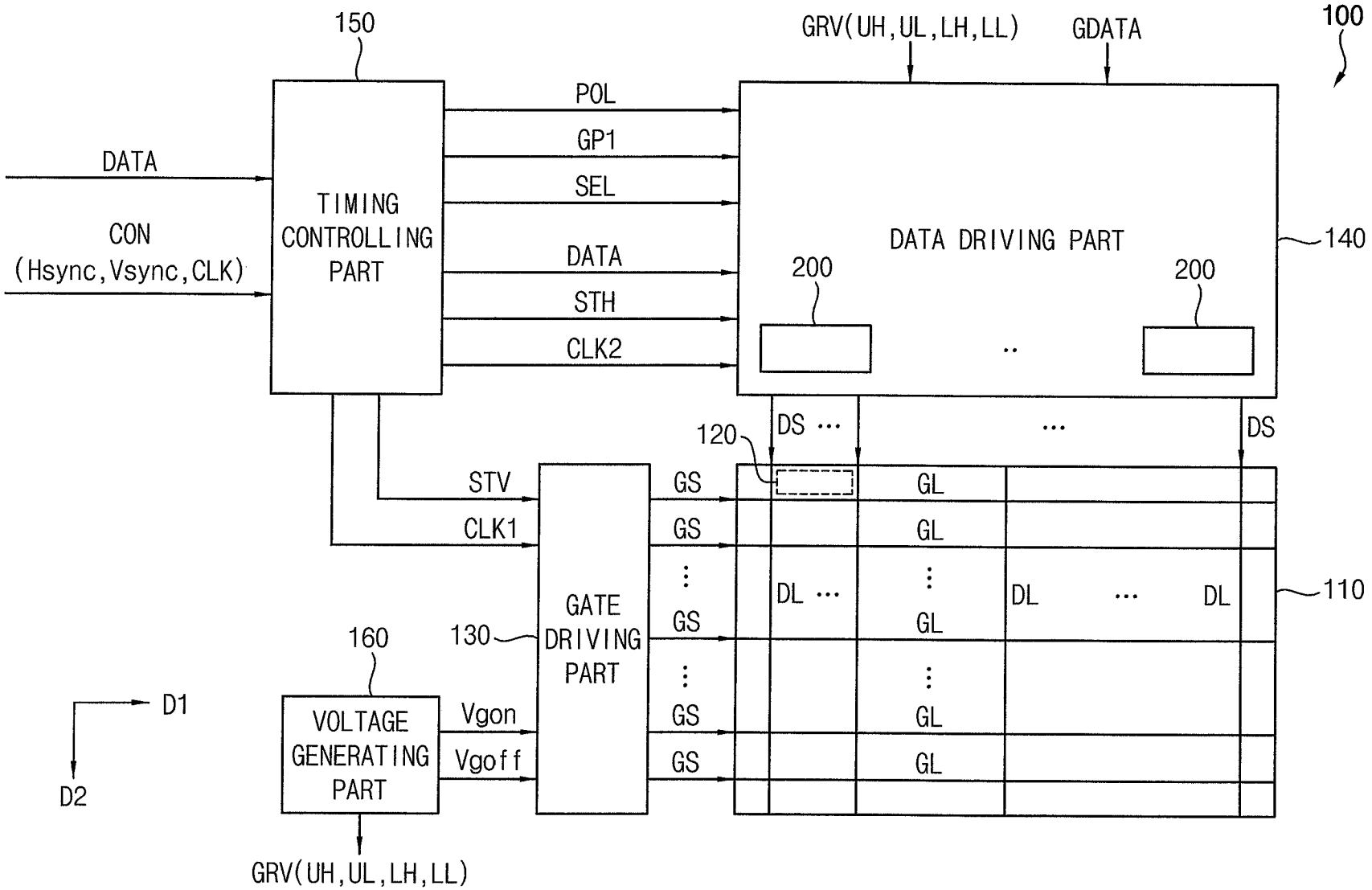
FIG. 1 is a block diagram illustrating an exemplary embodiment of a display apparatus according to the invention.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display apparatus according to an exemplary embodiment of the invention.

Referring to FIG. 1, the display apparatus 100 according to the exemplary embodiment includes a display panel 110, a gate driving part 130, a data driving part 140, a timing controlling part 150 and a voltage generating part 160.

The display panel 110 receives a data signal DS from the data driving part 140 to display an image. The display panel 110 includes gate lines GL, data lines DL and pixels 120. The gate lines GL extend in a first direction D1 and are arranged in a second direction D2 substantially perpendicular to the first direction D1. The data lines DL extend in the second direction D2 and are arranged in the first direction D1. Here, the first direction D1 may be parallel to a long side of the display panel 110, and the second direction D2 may be parallel to a short side of the display panel 110. In an exemplary embodiment, the display panel 110 may be a liquid crystal display panel including a liquid crystal, for example. In an exemplary embodiment, the display panel 110 may be a quantum dot display panel including a quantum dot, for example.

Figure 2:
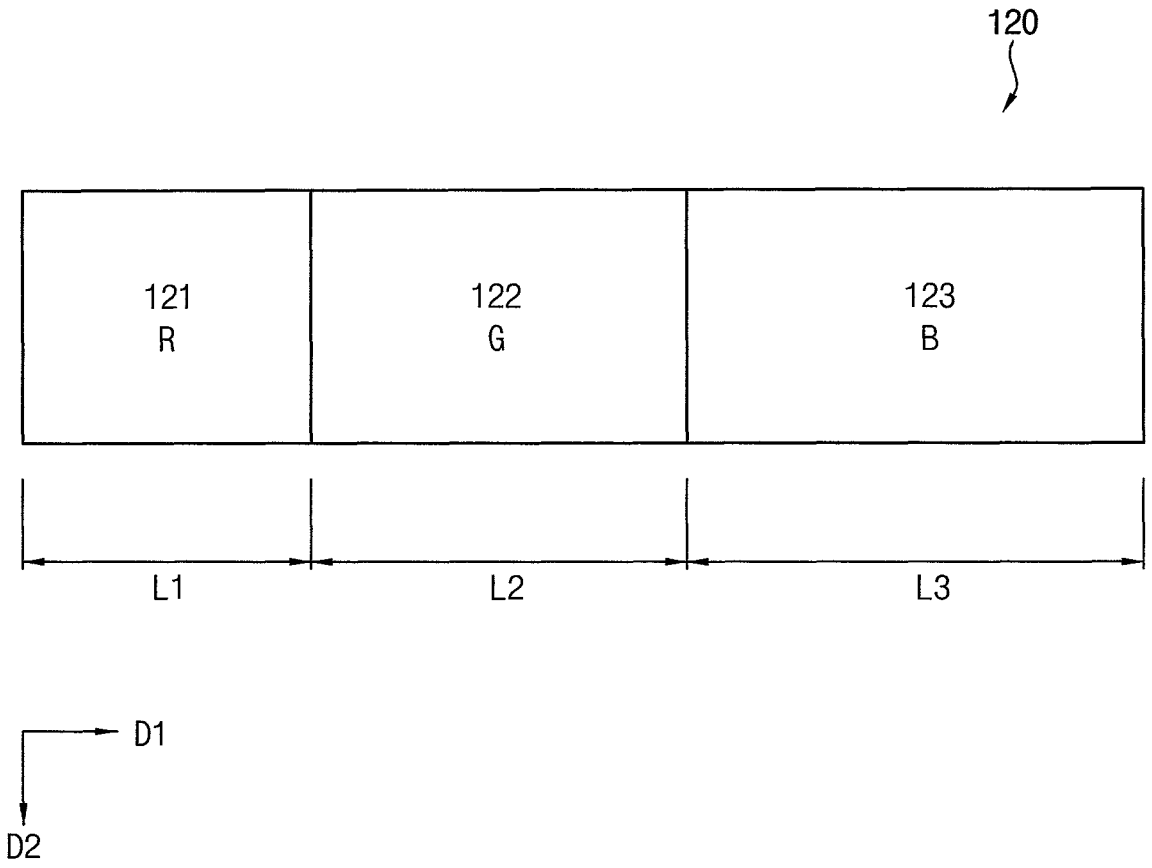
FIG. 2 is a plan view illustrating pixels of FIG. 1.

FIG. 2 is a plan view illustrating the pixels 120 of FIG. 1.

Referring to FIGS. 1 and 2, the pixels 120 may include a first color pixel 121, a second color pixel 122 and a third color pixel 123. In an exemplary embodiment, the first color pixel 121 may be a red pixel, the second color pixel 122 may be a green pixel, and the third color pixel 123 may be a blue pixel, for example.

A size of the first color pixel 121, a size of the second color pixel 122 and a size of the third color pixel 123 may be different from one another. Specifically, the first color pixel 121 may have a first length L1, the second color pixel 122 may have a second length L2 longer than the first length L1, and the third color pixel 123 may have a third length L3 longer than the second length L2, in the first direction D1.

Referring back to FIG. 1, the gate driving part 130, the data driving part 140 and the timing controlling part 150 may be defined as a display panel driving apparatus for driving the display panel 110.

The gate driving part 130 generates gate signals GS in response to a vertical start signal STV and a first clock signal CLK1 provided from the timing controlling part 150, and outputs the gate signals GS to the gate lines GL. The gate driving part 130 may receive a gate on voltage Vgon and a gate off voltage Vgoff from the voltage generating part 160, and may generate the gate signal GS using the gate on voltage Vgon and the gate off voltage Vgoff.

The data driving part 140 receives image data DATA from the timing controlling part 150, receives a gamma reference voltage GRV from the voltage generating part 160, and receives gamma data GDATA from an outside. In an exemplary embodiment, the data driving part 140 may receive the gamma data GDATA through an I2C communication including a serial data line ("SDL") and a serial clock line ("SCL"), for example. In an alternative exemplary embodiment, the data driving part 140 may receive the gamma data GDATA through an interface packet, for example.

The data driving part 140 generates the data signal DS based on the image data DATA, the gamma reference voltage GRV and the gamma data GDATA, and outputs the data signal DS to the data line DL in response to a horizontal start signal STH and a second clock signal CLK2 provided from the timing controlling part 150. The data driving part 140 may include a plurality of data driving integrated circuits 200 generating the data signal DS and outputting the data signal DS to the data line DL.

The timing controlling part 150 receives the image data DATA and a control signal CON from an outside. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140.

In addition, the timing controlling part 150 may further output, to the data driving part 140, a polarity control signal POL for controlling a positive polarity and a negative polarity of the data signal DS, first gamma point data GP1 for designating gamma point, and a selection signal SEL for selecting some of the gamma data GDATA.

The voltage generating part 160 generates the gate on voltage Vgon and the gate off voltage Vgoff, and outputs the gate on voltage Vgon and the gate off voltage Vgoff to the gate driving part 130. In addition, the voltage generating part 160 generates the gamma reference voltage GRV, and outputs the gamma reference voltage GRV to the data driving part 140. The gamma reference voltage GRV may include an upper high voltage UH, an upper low voltage UL, a lower high voltage LH, and a lower low voltage LL.

Figure 3:
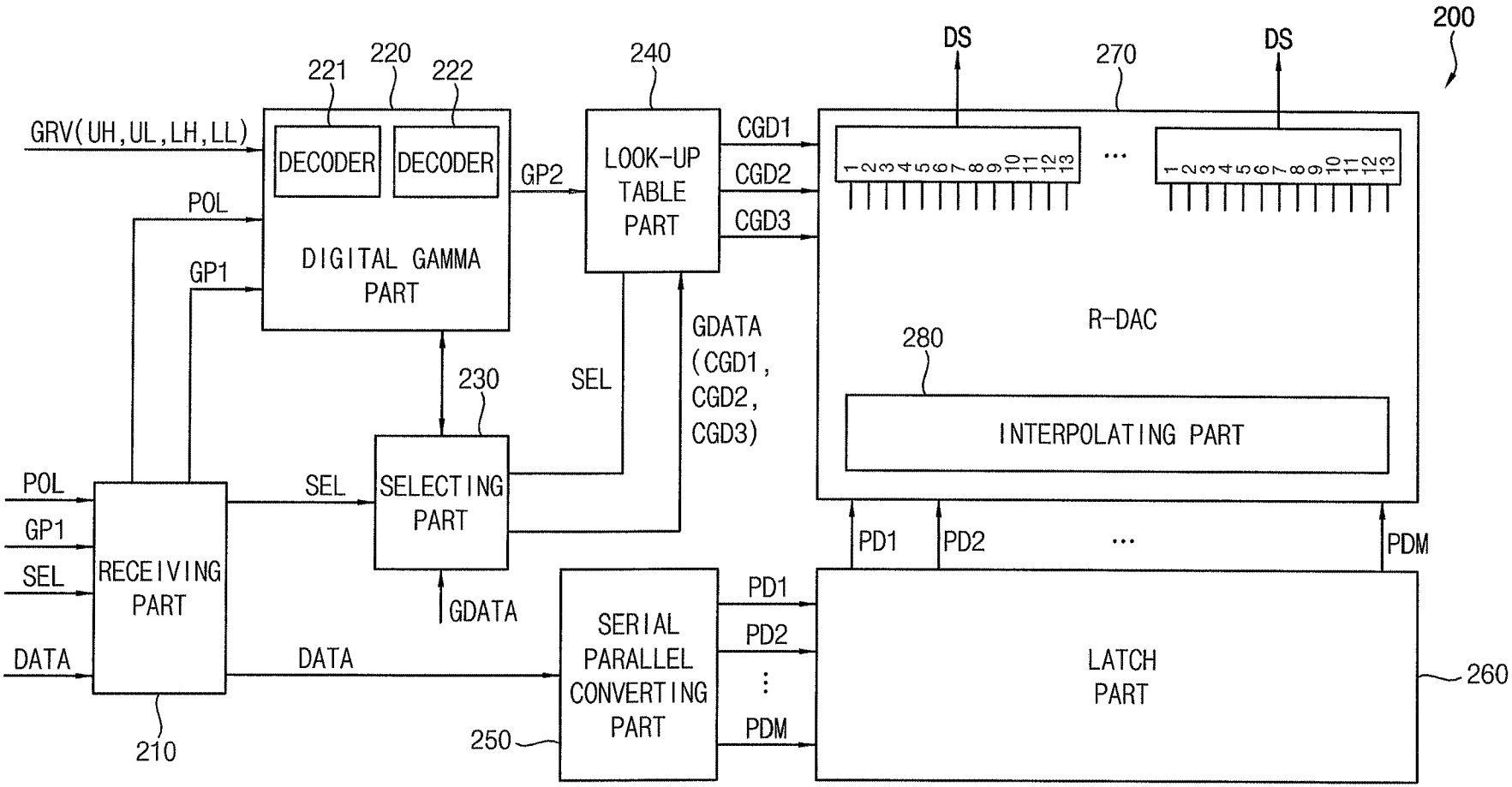
FIG. 3 is a block diagram illustrating a data driving integrated circuit of FIG. 1.

FIG. 3 is a block diagram illustrating the data driving integrated circuit 200 of FIG. 1.

Referring to FIGS. 1 and 3, the data driving integrated circuit 200 includes a receiving part 210, a digital gamma part 220, a selecting part 230, a look-up table ("LUT") part 240, a serial parallel converting part 250, a latch part 260 and a digital analog converting part 270.

The receiving part 210 receives the image data DATA, the polarity control signal POL, the first gamma point data GP1 and the selection signal SEL from the timing controlling part 150. The receiving part 210 outputs the image data DATA to the serial parallel converting part 250. In addition, the receiving part 210 outputs the polarity control signal POL and the first gamma point data GP1 to the digital gamma part 220. In addition, the receiving part 210 outputs the selection signal SEL to the selecting part 230.

The digital gamma part 220 receives the gamma reference voltage GRV from the voltage generating part 160. The gamma reference voltage GRV may include the upper high voltage UH, the upper low voltage UL, the lower high voltage LH, and the lower low voltage LL. In addition, the digital gamma part 220 receives the polarity control signal POL and the first gamma point data GP1 from the receiving part 210. The first gamma point data GP1 designates N (N is a natural number) gamma points. In an exemplary embodiment, the first gamma point data GP1 may designate 11 gamma points, for example.

The digital gamma part 220 includes a first decoder 221 and a second decoder 222. The number of the decoders 221 and 222 included in the digital gamma part 220 is substantially the same as the number of the polarities controlled by the polarity control signal POL. The data signal DS has the positive polarity and the negative polarity. Since the data signal DS has two polarities, the digital gamma part 220 includes two decoders 221 and 222. The digital gamma part 220 outputs second gamma point data GP2 designating 2N gamma points using the first decoder 221 and the second decoder 222. Specifically, the first decoder 221 outputs second gamma point data GP2 designating a gamma point of the positive polarity, and the second decoder 222 outputs second gamma point data GP2 designating a gamma point of the negative polarity.

The selecting part 230 receives the selection signal SEL from the receiving part 210. In addition, the selecting part 230 receives the gamma data GDATA from an outside, and outputs the gamma data GDATA to the LUT part 240. The gamma data GDATA may include first color gamma data CGD1, second color gamma data CGD2 and third color gamma data CGD3. In an exemplary embodiment, the first color gamma data CGD1 may be red gamma data, the second color gamma data CGD2 may be green gamma data, and the third color gamma data CGD3 may be blue gamma data, for example.

The selecting part 230 and the LUT part 240 selectively store the first color gamma data CGD1, the second color gamma data CGD2 and the third color gamma data CGD3 one by one, in response to the selection signal SEL. In addition, the selecting part 230 and the LUT part 240 selectively output the first color gamma data CGD1, the second color gamma data CGD2 and the third color gamma data CGD3 one by one, in response to the selection signal SEL.

Figure 4:
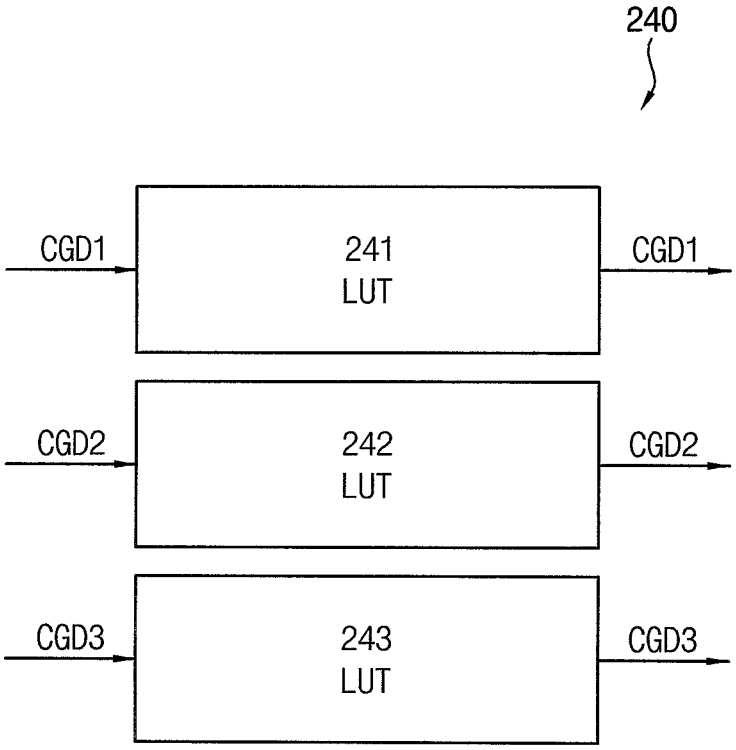
FIG. 4 is a block diagram illustrating a look-up table part of FIG. 3.

FIG. 4 is a block diagram illustrating the LUT part 240 of FIG. 3.

Referring to FIGS. 3 and 4, the LUT part 240 may include a first LUT 241, a second LUT 242 and a third LUT 243. The first LUT 241 may store and output the first color gamma data CGD1. The second LUT 242 may store and output the second color gamma data CGD2. The third LUT 243 may store and output the third color gamma data CGD3.

The selecting part 230 and the LUT part 240 may select the first color gamma data CGD1 among the first color gamma data CGD1, the second color gamma data CGD2 and the third color gamma data CGD3 in response to the selection signal SEL, and may store the first color gamma data CGD1 to the first LUT 241. In this case, the selecting part 230 may select the first LUT 241 among the first LUT 241, the second LUT 242 and the third LUT 243 in response to the selection signal SEL.

In addition, the selecting part 230 and the LUT part 240 may select the second color gamma data CGD2 among the first color gamma data CGD1, the second color gamma data CGD2 and the third color gamma data CGD3 in response to the selection signal SEL, and may store the second color gamma data CGD2 to the second LUT 242. In this case, the selecting part 230 may select the second LUT 242 among the first LUT 241, the second LUT 242 and the third LUT 243 in response to the selection signal SEL.

In addition, the selecting part 230 and the LUT part 240 may select the third color gamma data CGD3 among the first color gamma data CGD1, the second color gamma data CGD2 and the third color gamma data CGD3 in response to the selection signal SEL, and may store the third color gamma data CGD3 to the third LUT 243. In this case, the selecting part 230 may select the third LUT 243 among the first LUT 241, the second LUT 242 and the third LUT 243 in response to the selection signal SEL.

Therefore, the selecting part 230 may select the first LUT 241, the second LUT 242 and the third LUT 243 one by one, and may selectively store the first color gamma data CGD1, the second color gamma data CGD2 and the third color gamma data CGD3 one by one.

In addition, the selecting part 230 and the LUT part 240 may select the first color gamma data CGD1 among the first color gamma data CGD1, the second color gamma data CGD2 and the third color gamma data CGD3 in response to the selection signal SEL, and may output the first color gamma data CGD1 from the first LUT 241. In this case, the selecting part 230 may select the first LUT 241 among the first LUT 241, the second LUT 242 and the third LUT 243 in response to the selection signal SEL.

In addition, the selecting part 230 and the LUT part 240 may select the second color gamma data CGD2 among the first color gamma data CGD1, the second color gamma data CGD2 and the third color gamma data CGD3 in response to the selection signal SEL, and may output the second color gamma data CGD2 from the second LUT 242. In this case, the selecting part 230 may select the second LUT 242 among the first LUT 241, the second LUT 242 and the third LUT 243 in response to the selection signal SEL.

In addition, the selecting part 230 and the LUT part 240 may select the third color gamma data CGD3 among the first color gamma data CGD1, the second color gamma data CGD2 and the third color gamma data CGD3 in response to the selection signal SEL, and may output the third color gamma data CGD3 from the third LUT 243. In this case, the selecting part 230 may select the third LUT 243 among the first LUT 241, the second LUT 242 and the third LUT 243 in response to the selection signal SEL.

Therefore, the selecting part 230 may select the first LUT 241, the second LUT 242 and the third LUT 243 one by one, and may selectively output the first color gamma data CGD1, the second color gamma data CGD2 and the third color gamma data CGD3 one by one.

When the number of the gamma point is N, and thus the number of a gamma point of the positive polarity and a gamma point of the negative polarity is 2N, each of the number of gamma voltages of the first color gamma data CGD1, the number of gamma voltages of the second color gamma data CGD2 and the number of gamma voltages of the third color gamma data CGD3 may be 2N.

Referring back to FIG. 3, the serial parallel converting part 250 receives the image data DATA from the receiving part 210. The serial parallel converting part 250 converts the image data DATA to parallel data PD1, PD2, . . . , and PDM, and outputs the parallel data PD1, PD2, . . . , and PDM to the latch part 260.

The latch part 260 receives the parallel data PD1, PD2, . . . , and PDM from the serial parallel converting part 250, and latches the parallel data PD1, PD2, . . . , and PDM. The latch part 260 outputs the parallel data PD1, PD2, . . . , and PDM to the digital analog converting part 270. Each of the parallel data PD1, PD2, . . . , and PDM may be P (P is a natural number) bit. In an exemplary embodiment, each of the parallel data PD1, PD2, . . . , and PDM may be 10 bits, for example.

The digital analog converting part 270 generates the data signals DS using the first color gamma data CGD1, the second color gamma data CGD2, the third color gamma data CGD3 and the parallel data PD1, PD2, . . . , and PDM.

The digital analog converting part 270 may include an interpolating part 280. The interpolating part 280 receives each of the parallel data PD1, PD2, . . . , and PDM and outputs data of (P+Q(Q is a natural number)) bits. In an exemplary embodiment, 'P' may be 10, and 'Q' may be 3, for example. Therefore, each of the parallel data PD1, PD2, . . . , and PDM may be 10 bits, and each of the data output from the interpolating part 280 may be 13 bits, for example. In this case, each of the data signals DS output from the data driving part 140 may indicate 8192 grayscale values, for example. However, the invention is not limited thereto, and 'P' and 'Q' may have other values, and thereby each of the data signals DS output from the data driving part 140 may indicate other grayscale values.

Figure 5:
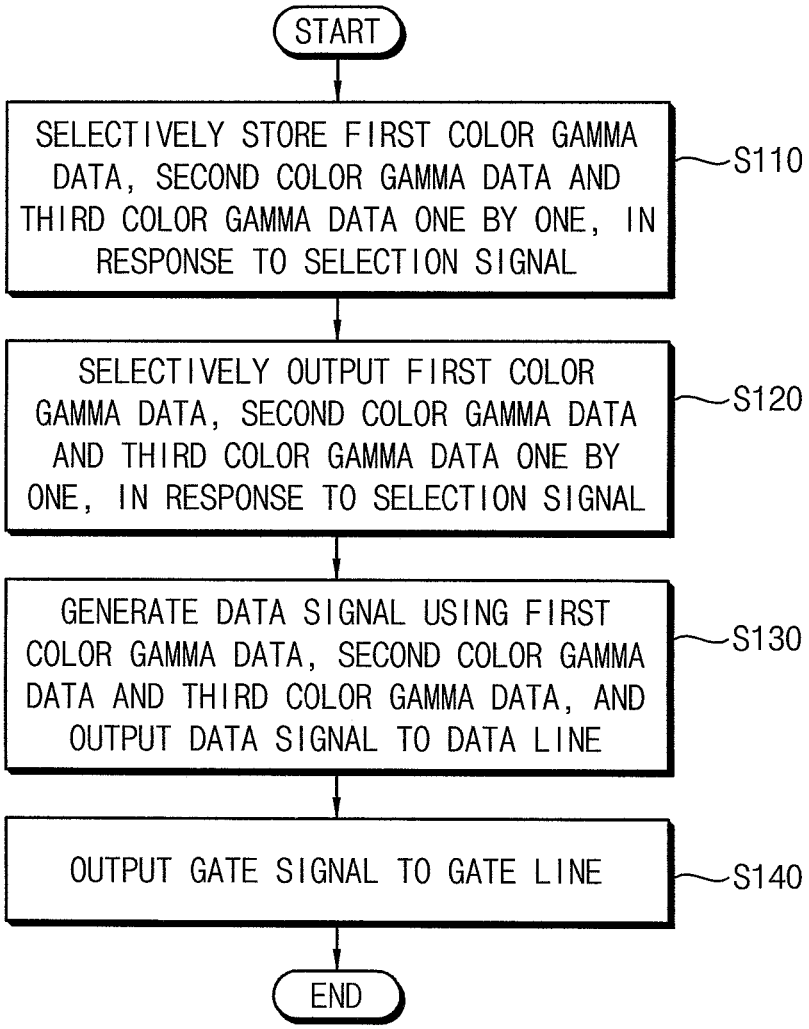
FIG. 5 is a flow chart illustrating a method of driving the display apparatus of FIG. 1.

FIG. 5 is a flow chart illustrating a method of driving the display apparatus 100 of FIG. 1.

Referring to FIGS. 1 and 3 to 5, the first color gamma data CGD1, the second color gamma data CGD2 and the third color gamma data CGD3 are selectively stored one by one, in response to the selection signal SEL (operation S110).

Specifically, the LUT part 240 may include the first LUT 241, the second LUT 242 and the third LUT 243.

The selecting part 230 and the LUT part 240 may select the first color gamma data CGD1 among the first color gamma data CGD1, the second color gamma data CGD2 and the third color gamma data CGD3 in response to the selection signal SEL, and may store the first color gamma data CGD1 to the first LUT 241. In this case, the selecting part 230 may select the first LUT 241 among the first LUT 241, the second LUT 242 and the third LUT 243 in response to the selection signal SEL.

In addition, the selecting part 230 and the LUT part 240 may select the second color gamma data CGD2 among the first color gamma data CGD1, the second color gamma data CGD2 and the third color gamma data CGD3 in response to the selection signal SEL, and may store the second color gamma data CGD2 to the second LUT 242. In this case, the selecting part 230 may select the second LUT 242 among the first LUT 241, the second LUT 242 and the third LUT 243 in response to the selection signal SEL.

In addition, the selecting part 230 and the LUT part 240 may select the third color gamma data CGD3 among the first color gamma data CGD1, the second color gamma data CGD2 and the third color gamma data CGD3 in response to the selection signal SEL, and may store the third color gamma data CGD3 to the third LUT 243. In this case, the selecting part 230 may select the third LUT 243 among the first LUT 241, the second LUT 242 and the third LUT 243 in response to the selection signal SEL.

Therefore, the selecting part 230 may select the first LUT 241, the second LUT 242 and the third LUT 243 one by one, and may selectively store the first color gamma data CGD1, the second color gamma data CGD2 and the third color gamma data CGD3 one by one.

The first color gamma data CGD1, the second color gamma data CGD2 and the third color gamma data CGD3 are selectively output one by one, in response to the selection signal SEL (operation S120).

Specifically, the selecting part 230 and the LUT part 240 may select the first color gamma data CGD1 among the first color gamma data CGD1, the second color gamma data CGD2 and the third color gamma data CGD3 in response to the selection signal SEL, and may output the first color gamma data CGD1 from the first LUT 241. In this case, the selecting part 230 may select the first LUT 241 among the first LUT 241, the second LUT 242 and the third LUT 243 in response to the selection signal SEL.

In addition, the selecting part 230 and the LUT part 240 may select the second color gamma data CGD2 among the first color gamma data CGD1, the second color gamma data CGD2 and the third color gamma data CGD3 in response to the selection signal SEL, and may output the second color gamma data CGD2 from the second LUT 242. In this case, the selecting part 230 may select the second LUT 242 among the first LUT 241, the second LUT 242 and the third LUT 243 in response to the selection signal SEL.

In addition, the selecting part 230 and the LUT part 240 may select the third color gamma data CGD3 among the first color gamma data CGD1, the second color gamma data CGD2 and the third color gamma data CGD3 in response to the selection signal SEL, and may output the third color gamma data CGD3 from the third LUT 243. In this case, the selecting part 230 may select the third LUT 243 among the first LUT 241, the second LUT 242 and the third LUT 243 in response to the selection signal SEL.

Therefore, the selecting part 230 may select the first LUT 241, the second LUT 242 and the third LUT 243 one by one, and may selectively output the first color gamma data CGD1, the second color gamma data CGD2 and the third color gamma data CGD3 one by one.

The data signal DS is generated using the first color gamma data CGD1, the second color gamma data CGD2 and the third color gamma data CGD3, and the data signal DS is output to the data line DL (operation S130).

Specifically, the serial parallel converting part 250 receives the image data DATA from the receiving part 210. The serial parallel converting part 250 converts the image data DATA to the parallel data PD1, PD2, . . . , and PDM, and outputs the parallel data PD1, PD2, . . . , and PDM to the latch part 260.

The latch part 260 receives the parallel data PD1, PD2, . . . , and PDM from the serial parallel converting part 250, and latches the parallel data PD1, PD2, . . . , and PDM. The latch part 260 outputs the parallel data PD1, PD2, . . . , and PDM to the digital analog converting part 270. Each of the parallel data PD1, PD2, . . . , and PDM may be P (P is a natural number) bit. In an exemplary embodiment, each of the parallel data PD1, PD2, . . . , and PDM may be 10 bits, for example.

The digital analog converting part 270 generates the data signals DS using the first color gamma data CGD1, the second color gamma data CGD2, the third color gamma data CGD3 and the parallel data PD1, PD2, . . . , and PDM.

The digital analog converting part 270 may include the interpolating part 280. The interpolating part 280 receives each of the parallel data PD1, PD2, . . . , and PDM and outputs the data of (P+Q(Q is a natural number)) bits. In an exemplary embodiment, 'P' may be 10, and 'Q' may be 3, for example. Therefore, each of the parallel data PD1, PD2, . . . , and PDM may be 10 bits, and each of the data output from the interpolating part 280 may be 13 bits, for example. In this case, each of the data signals DS output from the data driving part 140 may indicate 8192 grayscale values, for example. However, the invention is not limited thereto, and 'P' and 'Q' may have other values, and thereby each of the data signals DS output from the data driving part 140 may indicate other grayscale values.

The data driving part 140 outputs the data signal DS to the data line DL in response to the horizontal start signal STH and the second clock signal CLK2 provided from the timing controlling part 150.

The gate signal GS is output to the gate line GL (operation S140).

Specifically, the gate driving part 130 generates the gate signals GS in response to the vertical start signal STV and the first clock signal CLK1 provided from the timing controlling part 150, and outputs the gate signals GS to the gate lines GL. The gate driving part 130 may receive the gate on voltage Vgon and the gate off voltage Vgoff from the voltage generating part 160, and may generate the gate signal GS using the gate on voltage Vgon and the gate off voltage Vgoff.

According to the exemplary embodiment, the data driving part 140 stores and outputs the first color gamma data CGD1, the second color gamma data CGD2 and the third color gamma data CGD3. Therefore, although the display panel 110 includes the first color pixel 121, the second color pixel 122 and the third color pixel 123 having different sizes from one another, and thus a gamma characteristic of a first color, a gamma characteristic of a second color and a gamma characteristic of a third color are different from one another, an image of improved display quality may be displayed adaptively to the first color, the second color and the third color.

In addition, a decoder according to the first color, the second color and the third color is not desired to the data driving part 140, and thus a size and a manufacturing cost of the display apparatus 100 may be decreased.

The exemplary embodiments may be applied to an electronic device having a display apparatus. The exemplary embodiments may be applied to various electronic devices such as a television, a computer monitor, a laptop, a digital camera, a cellular phone, a smart phone, a tablet personal computer ("PC"), a smart pad, a personal digital assistant ("PDA"), a portable multimedia player ("PMP"), an MP3 player, a navigation system, a camcorder, a portable game console, etc., for example.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image, and includes a pixel, a gate line and a data line both connected to the pixel;

a gate driving part which outputs a gate signal to the gate line; and a data driving part which outputs a data signal to the data line, selectively stores first color gamma data, second color gamma data and third color gamma data one by one in response to a selection signal during each frame, selectively outputs the first color gamma data, the second color gamma data and the third color gamma data one by one in response to the selection signal during the each frame, and generates the data signal to the pixel via the data line using the first color gamma data, the second color gamma data and the third color gamma data in response to the gate signal to the gate line.

2. The display apparatus of claim 1, wherein the data driving part comprises a look-up table part which stores the first color gamma data, the second color gamma data and the third color gamma data.

3. The display apparatus of claim 2, wherein the look-up table part comprises:

a first look-up table which stores the first color gamma data;

a second look-up table which stores the second color gamma data; and a third look-up table which stores the third color gamma data.

4. The display apparatus of claim 3, wherein the data driving part further comprises a selecting part which selects one of the first look-up table, the second look-up table and the third look-up table in response to the selection signal, in order to selectively output the first color gamma data, the second color gamma data and the third color gamma data.

5. The display apparatus of claim 4, wherein the selecting part selectively outputs the first color gamma data, the second color gamma data and the third color gamma data by selecting the first look-up table, the second look-up table and the third look-up table one by one.

6. The display apparatus of claim 4, wherein the selecting part receives gamma data comprising the first color gamma data, the second color gamma data and the third color gamma data.

7. The display apparatus of claim 6, wherein the selecting part selectively stores the first color gamma data, the second color gamma data and the third color gamma data by selecting the first look-up table, the second look-up table and the third look-up table one by one.

8. The display apparatus of claim 6, wherein the data driving part receives the gamma data through an inter-integrated circuit communication using a serial data line and a serial clock line.

9. The display apparatus of claim 1, wherein the data driving part comprises a digital gamma part which receives first gamma point data designating N gamma point where N is a natural number, and outputs second gamma point data designating 2N gamma points.

10. The display apparatus of claim 9, wherein the digital gamma part receives a polarity control signal controlling a positive polarity and a negative polarity of the data signal.

11. The display apparatus of claim 10, wherein the digital gamma part comprises:

a first decoder which outputs gamma point data of the positive polarity; and a second decoder which outputs gamma point data of the negative polarity.

12. The display apparatus of claim 10, wherein the first color gamma data comprises 2N gamma voltages.

13. The display apparatus of claim 10, wherein the second color gamma data comprises 2N gamma voltages.

14. The display apparatus of claim 10, wherein the third color gamma data comprises 2N gamma voltages.

15. The display apparatus of claim 1, wherein the data driving part comprises:

a serial parallel converting part which receives image data for displaying the image and to output parallel data of P bit, where P is a natural number; and an interpolating part which receives the parallel data and to output data of (P+Q) bit, where Q is a natural number.

16. The display apparatus of claim 1, wherein the display panel comprises a first color pixel, a second color pixel and a third color pixel, and a size of the first color pixel, a size of the second color pixel and a size of the third color pixel are different from one another.

17. The display apparatus of claim 16, wherein the first color pixel has a first length, the second color pixel has a second length longer than the first length, and the third color pixel has a third length longer than the second length, in a direction in which the gate line extends.

18. The display apparatus of claim 1, wherein the first color gamma data is red gamma data, the second color gamma data is green gamma data, and the third color gamma data is blue gamma data.

19. The display apparatus of claim 1, wherein the display panel is a quantum dot display panel including a quantum dot.

20. The display apparatus of claim 1, wherein the voltage generating part and data driving part have a total of two decoders between them.

21. A method of driving a display apparatus, the method comprising:

selectively storing first color gamma data, second color gamma data and third color gamma data one by one in response to a selection signal during each frame;

selectively outputting the first color gamma data, the second color gamma data and the third color gamma data one by one in response to the selection signal during the each frame;

generating a data signal to a data line connected to a pixel of a display panel using the first color gamma data, the second color gamma data and the third color gamma data;

outputting a gate signal to a gate line of the display panel, the gate line connected to the pixel; and outputting the data signal to the data line of the display panel.

* * * * *